United States Patent [19]

Najmowicz et al.

[11] 4,117,878

[45] Oct. 3, 1978

[54] UNIT FOR CENTRIFUGAL CASTING OF METALS IN SPLIT MOULDS

[75] Inventors: Zenon Najmowicz, Zabrze; Edward Dyrda, Gliwice; Jan Zakrzewski, Cracow, all of Poland

[73] Assignee: Przedsiębiorstwo Projektowania i Wyposażania Zakładów Prezemysłu Maszyn i Aparatów Elektrycznych "Promel", Gliwice, Poland

[21] Appl. No.: 743,353

[22] Filed: Nov. 19, 1976

[30] Foreign Application Priority Data

Nov. 20, 1975 [PL] Poland ..... 184877

[51] Int. Cl.[2] ..... B22D 13/00; B22D 12/00

[52] U.S. Cl. ..... 164/292; 164/298; 164/341; 164/342; 425/435

[58] Field of Search ..... 164/286, 292, 298, 339, 164/341, 342, 114, 324; 249/137; 425/435

[56] References Cited

U.S. PATENT DOCUMENTS

| | | | |
|---|---|---|---|
| 1,980,742 | 11/1934 | Bigler | 164/298 |
| 2,047,588 | 7/1936 | Ledeboer | 164/292 |
| 2,381,616 | 8/1945 | Pfleger | 164/292 X |
| 2,512,071 | 6/1950 | Nolan | 164/292 |
| 3,171,171 | 3/1965 | Farr et al. | 164/298 X |
| 3,781,157 | 12/1973 | Maringer et al. | 249/137 X |
| 3,825,057 | 7/1974 | Baumann et al. | 164/292 |

FOREIGN PATENT DOCUMENTS

| | | | |
|---|---|---|---|
| 2,054,168 | 5/1971 | Fed. Rep. of Germany | 425/435 |

*Primary Examiner*—Francis S. Husar
*Assistant Examiner*—Gus T. Hampilos
*Attorney, Agent, or Firm*—Haseltine, Lake, & Waters

[57] ABSTRACT

Centrifugal casting apparatus comprising a rotatable sleeve supported at a fixed axial location and having a conically tapered internal surface, and a driving sleeve axially spaced with respect to the rotatable sleeve and having a conically tapered internal surface opposed to the internal surface of the rotatable sleeve. The driving sleeve is driven in rotation and it is axially displaced with respect to the rotatable sleeve. A split mold assembly is disposed between the rotatable sleeve and the driving sleeve and includes a casing and a plurality of mold segments slidably supported by the casing. The mold segments are radially moveable towards and away from the axis of rotation between a closed mold position and a opened mold position. The mold segments can be locked in the open and closed positions. Cone elements are secured to the mold segments and cooperatively define conical elements at respective ends of the mold assembly which face the conically tapered internal surfaces of the sleeves with the mold segments in closed position. The conical elements are of corresponding taper as and engageable in the conically tapered surfaces for driving the mold assembly in rotation. Molten metal can be introduced into the mold assembly via the rotatable sleeve.

6 Claims, 4 Drawing Figures

UNIT FOR CENTRIFUGAL CASTING OF METALS IN SPLIT MOULDS

FIELD OF THE INVENTION

The invention relates to apparatus for centrifugal casting in split rotational molds, designed to produce shaped cylindrical castings of steel and metal alloys.

The shape of cavities and bosses in the external casting surface corresponds to that of the split mold pattern, the internal surface of the casting being smooth and cylindrical as regards its shape.

PRIOR ART

According to the German Pat. No. 2,360,760, collapsible molds are known for the centrifugal casting of ribbed structures, special means being provided along the outer surfaces of permanent mold segments to fix the individual segments into one unit by means of joints.

On the other hand, extreme outer faces of the permanent mold segments are provided with ring-shaped plate sectors which, after assembly of the individual segments, form rings that have external borders or rims that enable the rotation of the mold.

Following the structure as disclosed in the abovementioned German Patent, the procedure of closing the mold and its opening to remove the castings is very laborious since every time the bolts for fastening of the individual segments have to be put into the respective holes of the unit, and then nuts have to be placed into position and tightened.

When opening the permanent molds, the reverse sequence of operations is needed, i.e. one has to unscrew the joints, which can be done only after having inserted the mandrel, and turning the set of permanent molds so as to bring the center lines into a vertical position.

SUMMARY OF THE INVENTION

The present invention has as its object to avoid these inconveniences, which entail very laborious and toilsome steps in joining together and then separating the mold parts, namely the hot segments thereof, by the use of the known screw joints.

According to major features of the present invention, this object is attained by providing a unit for centrifugal casting, complete with the split mold assembly (that can be opened and shut), allowing easy and quick closing and opening of the mold, as well as tightening of the mold segments during its rotation, with the simultaneous possibility of coupling the mold assembly and a power or drive unit.

It is considered to be essential for the present invention that the unit for centrifugal casting has split molds that are driven by a stationary power unit with an infinitely variable speed control. The unit is equipped with a rotational sleeve pivoted in a fixed casing, and a hold-down driving sleeve secured to a spline shaft, the latter being guided in a profiled non-slidable sleeve and drives in rotation via V-belts by the power unit. The spline shaft is preferably displaceable axially by a piston rod of a hydraulic servo-motor.

The fixed sleeve and the hold-down sleeve have openings or holes in the form of circular cones, with surfaces that adjoin, in the closed condition of the mold, the conical elements in the split mold assembly.

Through a port in the fixed rotational sleeve, a runner can be arranged for supplying the metal.

According to further, optional features of the invention, the split mold assembly may consist of segments that are slidably mounted by means of guides or slide ways.

The pairs of guides may be rigidly coupled with a grip to close and open the mold segments, each guide having two cut-outs to lock the respective mold segment in position by means of a swingable pawl.

External flanks of all mold segments are preferably provided with fixed elements which, in the closed mold condition, form hollow circular frustums of a cone with their bases facing the mold center.

The split mold assembly has rims that form circular rings, or square-outlined rims for the same purpose.

The rings are preferably permanently fixed to the rim flanks, constituting races to allow the mold assembly to rotate on rolls.

Finally, it is also within the purview of the present invention, wherein the inventive device can be associated with any number of the split mold assemblies, that the feeding of these assemblies to a centrifuging station can be effected by means of a circulating mechanized line, or a rotating table.

BRIEF DESCRIPTION OF THE DRAWINGS

A preferred, exemplary embodiment of the inventive unit for the centrifugal casting of steel or metals in split molds will now be explained in more detail in a detailed specification, with reference to the accompanying drawings, wherein.

DETAILED DESCRIPTION

Figure 1:
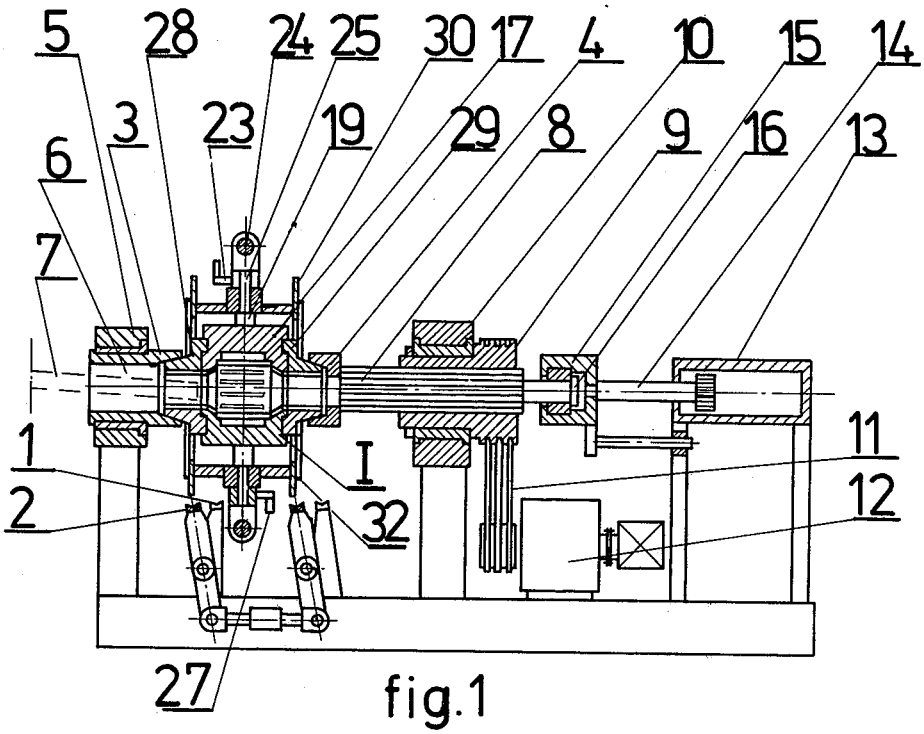
FIG. 1 illustrates a vertical section through a mold assembly with which the inventive unit is associated.
Figure 2:
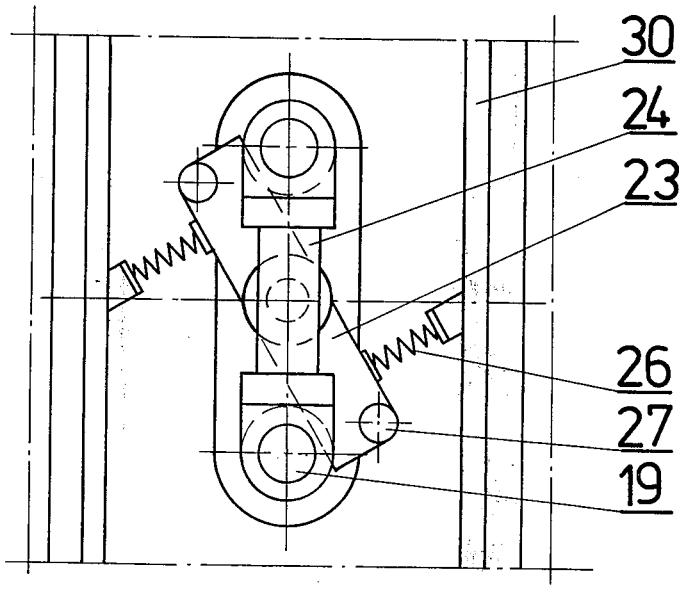
FIG. 2 is a side view of a swingable pawl to lock segments of the mold in position.

The inventive unit for centrifugal casting is provided with replaceable mold assemblies including elements 1 which are led along a stationary path I into a swinging path 2 arranged between a rotational sleeve 3 and a hold-down driving sleeve 4. The rotational sleeve 3 is rotatably mounted in a casing 5 and has a port 6 for a runner 7 to supply the molten metal alloy or steel into the mold cavity. The port 6 is cone-shaped when viewed from the mold assembly side. The hold-down driving sleeve 4 also has an internal cone-shaped hole and is rigidly joined with a spline shaft 8, the latter being slidably fitted in a profiled sleeve 9.

The sleeve 9 is rotatably and non-slideably mounted in a casing 10, and has grooves for V-belts 11 to transmit rotational motion from a power unit 12 which has infinitely variable speed control to spline shaft 8. By the spline shaft 8, complete with the hold-down sleeve 4, and motion is transmitted from a hydraulic servomotor 13; a piston rod 14 of the latter being pivoted, via a bearing 15, with the spline shaft 8 and a pin 16.

The split mold assembly I consists of preferably four segments 17 sliding in a casing 18 by means of a pair of guides 19. The segments, in the closed mold condition, adjoin or touch each other along parting planes 20, and constitute a unit, the outlines of the internal face determining the external casting shape.

Each guide 19 has two cut-outs 21, 22 to position the segments 17 of the mold in respective open and preclosed positions by means of a swingable pawl 23. The guides 19 relevant to the mold segments 17, outside the casing 18, are rigidly coupled through a grip 24 which serves for moving the segments together with the pair of guides 19. The pawl 23 is pivoted in the casing 18 via a pin 25 and permanently pressed against the guides 19 by springs 26. At its ends, the swingable pawl 23 is provided with protruding pins 27 enabling the pawl to swing.

Figure 3:
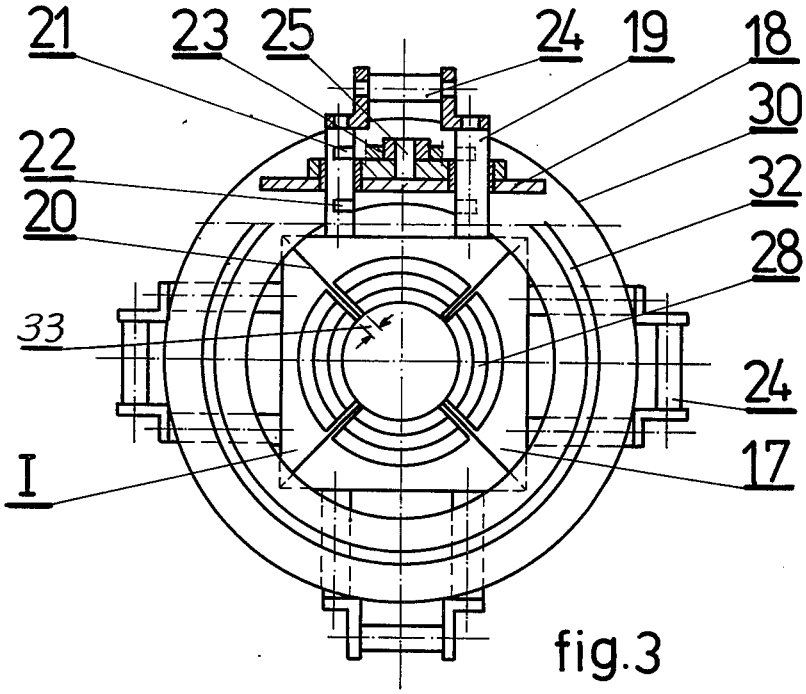
FIG. 3 is a side view of the mold assembly in its preliminary or closed condition.
Figure 4:
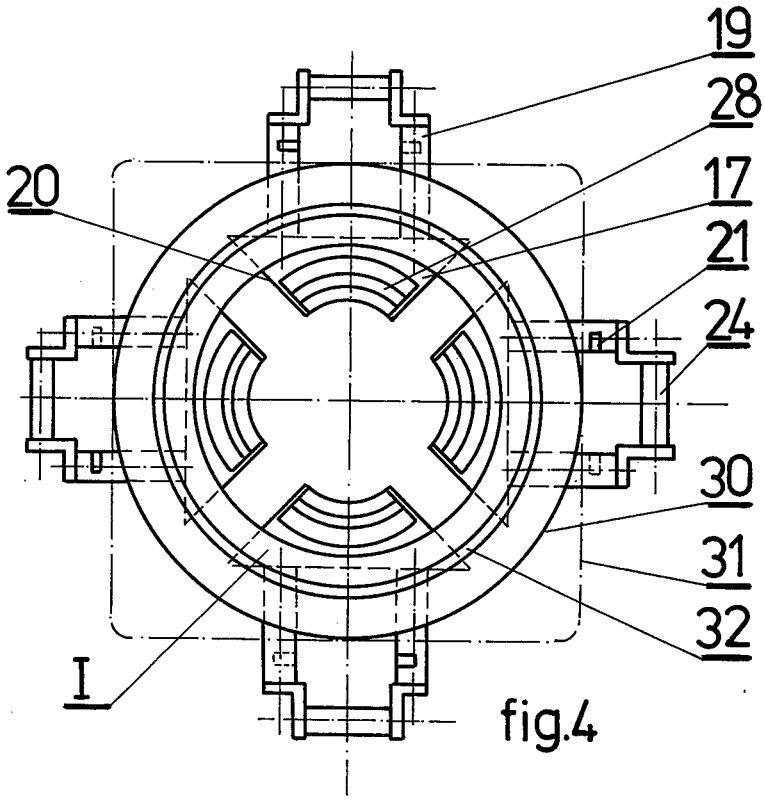
FIG. 4 is a side view of the mold in its open or parted condition.

Hollow cone frustum elements 28, 29, with the cone bases facing the mold center, are permanently secured to the external flanks of all the mold segments 17 and elements have gaps 33 for cooperating with the segments 17. The parting planes of the cones formed by closing the elements 27, 28 coincide with the mold parting planes. However, as seen in FIG. 3, in the closed position of the mold, there is a small gap 33 between elements 28.

The split mold assembly casing 18 has rims 30 forming a circular ring to enable the mold assembly I to roll over the stationary path 1. Alternatively, square-outlined rims 31 can be used for rolling over the roll path.

To the rims 30, 31, at the flanks of the casing 18, rings 32 are permanently fixed to allow rotaton of the split mold assembly I on the rolls when closing or opening the mold assembly, and for removing the castings therefrom.

It will be understood by those skilled in the art that various modifications, changes and additions can be made in the inventive unit for centrifugal casting, without departing from the spirit and scope of the present invention.

We claim:

1. Centrifugal casting apparatus comprising a rotatable sleeve supported at a fixed axial location and having a conically tapered internal surface, a driving sleeve axially spaced with respect to said rotatable sleeve and having a conically tapered internal surface opposed to the internal surface of said rotatable sleeve, means for rotating said driving sleeve about an axis or rotation, means for axially displacing said driving sleeve relative to said rotatable sleeve, a split mold assembly disposed between said rotatable sleeve and driving sleeve and including a casing and a plurality of mold segments slidably supported by said casing, means for moving said mold segments radially towards and away from the axis of rotation between a closed mold portion and an open mold position, locking means for locking said mold segments in the open and closed positions, core elements secured to said mold segments and cooperatively defining conical elements at respective ends of said mold assembly which face said conically tapered internal surfaces of said sleeves with the mold segments in closed position, said conical elements being of corresponding taper as and engageable in said conically tapered surfaces for driving said mold assembly in rotation, and means for introducing molten material into said mold assembly via said rotatable sleeve.

2. Apparatus as claimed in claim 1 wherein said core elements define gaps between one another in the closed position of the molds.

3. Apparatus as claimed in claim 1 wherein said means for moving the mold segments between open and closed positions comprises guides secured to each mold segment, said guides being provided with recesses, said locking means comprising pivotal pawls on said casing positioned to engage in said recesses, spring means urging said pawls into engagement in said recesses, and pin means on said pawls.

4. Apparatus as claimed in claim 1 wherein said casing includes rims on said mold assembly and rings affixed to said rims to permit rotation of the mold assembly when opening or closing the mold segments.

5. Apparatus as claimed in claim 4 wherein said rims are circular in shape.

6. Apparatus as claimed in claim 4 wherein said rims are square in shape.

* * * * *